US011280304B1

(12) United States Patent
Moreno et al.

(10) Patent No.: US 11,280,304 B1
(45) **Date of Patent: *Mar. 22, 2022**

(54) FUEL PRESSURE REGULATOR

(71) Applicant: DELPHI TECHNOLOGIES IP LIMITED, St. Michael (BB)

(72) Inventors: Alejandro Moreno, El Paso, TX (US); Francisco Morales, Chihuahua (MX); Victor A. Schiaffino, Chihuahua (MX)

(73) Assignee: DELPHI TECHNOLOGIES IP LIMITED

( * ) Notice: Subject to any disclaimer, the term of this patent is extended or adjusted under 35 U.S.C. 154(b) by 0 days.

This patent is subject to a terminal disclaimer.

(21) Appl. No.: 17/099,162

(22) Filed: Nov. 16, 2020

(51) Int. Cl.
*F02M 1/00* (2006.01)
*F02M 37/00* (2006.01)
*F02M 63/02* (2006.01)

(52) U.S. Cl.
CPC ..... *F02M 37/0082* (2013.01); *F02M 63/023* (2013.01); *F02M 63/0265* (2013.01); *F02M 63/0275* (2013.01)

(58) Field of Classification Search
CPC ..... F02M 55/04; F02M 63/0035; F02M 63/0052; F02M 63/0235; F02M 69/54; F02M 63/0075; F02M 2200/9015; F02M 63/0077; F02M 63/005; F02M 21/023; F16K 1/00; F16K 15/14; F16K 17/0433
See application file for complete search history.

(56) References Cited

U.S. PATENT DOCUMENTS

| | | | | |
|---|---|---|---|---|
| 4,007,907 | A * | 2/1977 | Branson | F23N 1/007 251/85 |
| 4,670,194 | A * | 6/1987 | Buford | F02M 69/08 261/121.2 |
| 5,265,644 | A | 11/1993 | Tuckey | |
| 5,950,652 | A * | 9/1999 | Morgan | G05D 16/0661 137/14 |
| 2003/0230930 | A1 | 12/2003 | Inage et al. | |
| 2016/0215741 | A1 | 7/2016 | Porras et al. | |
| 2016/0282884 | A1* | 9/2016 | Greenwood | G05D 16/0608 |
| 2019/0003474 | A1* | 1/2019 | Fochtman | F02M 55/007 |
| 2019/0264847 | A1* | 8/2019 | Blanchard | F16L 25/026 |
| 2020/0102924 | A1* | 4/2020 | Perry | F16K 15/026 |
| 2020/0347811 | A1* | 11/2020 | Moreno | F02M 63/0075 |

* cited by examiner

*Primary Examiner* — John Kwon
(74) *Attorney, Agent, or Firm* — Joshua M. Haines

(57) ABSTRACT

A fuel pressure regulator includes a fuel inlet; a fuel outlet; a seating surface; and a valve member assembly. The valve member assembly includes a poppet and also includes a sealing member which is centered about a valve member assembly axis, is annular in shape, and includes a sealing member surface. The valve member assembly is moveable between 1) a closed position in which the sealing member surface annularly engages the seating surface, thereby preventing fuel flow from the fuel inlet to the fuel outlet and 2) an open position in which at least a portion of the sealing member surface is spaced apart from the seating surface, thereby allowing fuel flow from the fuel inlet to the fuel outlet. A spring biases the valve member assembly toward the closed position and is centered about a spring axis which is laterally offset relative to the valve member assembly axis.

20 Claims, 6 Drawing Sheets

FUEL PRESSURE REGULATOR

TECHNICAL FIELD OF INVENTION

The present disclosure relates to a fuel pressure regulator, and more particularly to a fuel pressure regulator which includes a valve member assembly which pivots when moving between a closed position and an open position.

BACKGROUND OF INVENTION

Fuel systems for supplying liquid fuel, by way of non-limiting example only, gasoline or diesel fuel, to an internal combustion engine typically include a fuel tank for storing a volume of fuel, a fuel pump for pumping fuel from the fuel tank to a fuel rail mounted to the internal combustion engine. The fuel rail includes a plurality of fuel injectors such that each fuel injector is arranged to inject fuel, either directly or indirectly, to a respective combustion chamber of the internal combustion engine. The fuel rail provides a common volume of fuel from which each of the plurality of fuel injectors receives fuel. The fuel pump is typically designed to provide fuel at a constant flow and pressure that meets or exceeds the requirements of the internal combustion engine at maximum output of the internal combustion engine. However, the internal combustion engine is primarily operated below its maximum output capability, and consequently, typically does not require all of the fuel supplied by the fuel pump. Consequently, the fuel system typically includes a fuel pressure regulator which maintains a constant pressure within the fuel rail, or supplied to a high-pressure pump in the case of a direct injection system, by recirculating a portion of the fuel pump output back to the fuel tank. The fuel pressure regulator may be located within the fuel tank or remote from the fuel tank.

One type of fuel pressure regulator is shown in U.S. Pat. No. 5,265,644 to Tuckey. The fuel pressure regulator of Tuckey includes a valve member which is spherical and which selectively seats on a frustoconical seat to prevent flow through the fuel pressure regulator. A known issue with such fuel pressure regulators is that movement of the valve member between open and closed positions is susceptible to hysteresis due to the possibility of misalignment occurring between the valve member and the seat. Furthermore, if the valve member is made of an elastomer material, the valve member may become stuck on the seat because the valve member can elastically deform and wedge into the seat. Also furthermore, if the spherical valve member is made of metal, the seat may require post processing such as coining, burnishing, and/or lapping to ensure proper sealing is provided when the valve member is seated on the seat. For these reasons, current fuel pressure regulators may require added cost and complexity to ensure desired operation.

What is needed is a fuel pressure regulator which minimizes or eliminates one or more the shortcomings as set forth above.

SUMMARY OF THE INVENTION

Briefly described, a fuel pressure regulator includes a fuel inlet; a fuel outlet; a seating surface between the fuel inlet and the fuel outlet which is annular in shape; a valve member assembly comprising a poppet and also comprising a sealing member which is made of an elastomer material and which is annular in shape and includes a sealing member surface such that the sealing member is centered about a valve member assembly axis, the sealing member being supported by the poppet, and the valve member assembly being moveable between 1) a closed position in which the sealing member surface annularly engages the seating surface, thereby preventing fuel flow from the fuel inlet to the fuel outlet and 2) an open position in which at least a portion of the sealing member surface is spaced apart from the seating surface, thereby allowing fuel flow from the fuel inlet to the fuel outlet; and a spring which biases the valve member assembly toward the closed position, wherein the spring is centered about a spring axis which is laterally offset relative to the valve member assembly axis, thereby causing the valve member assembly to pivot, when moving between the closed position and the open position, about a pivot interface created by the seating surface contacting the sealing member surface. The fuel pressure regulator as described herein allows for a positive seal in the closed position, is compact, and is simple and inexpensive to manufacture. Furthermore, the pivoting nature of the valve member assembly minimizes hysteresis and noise.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
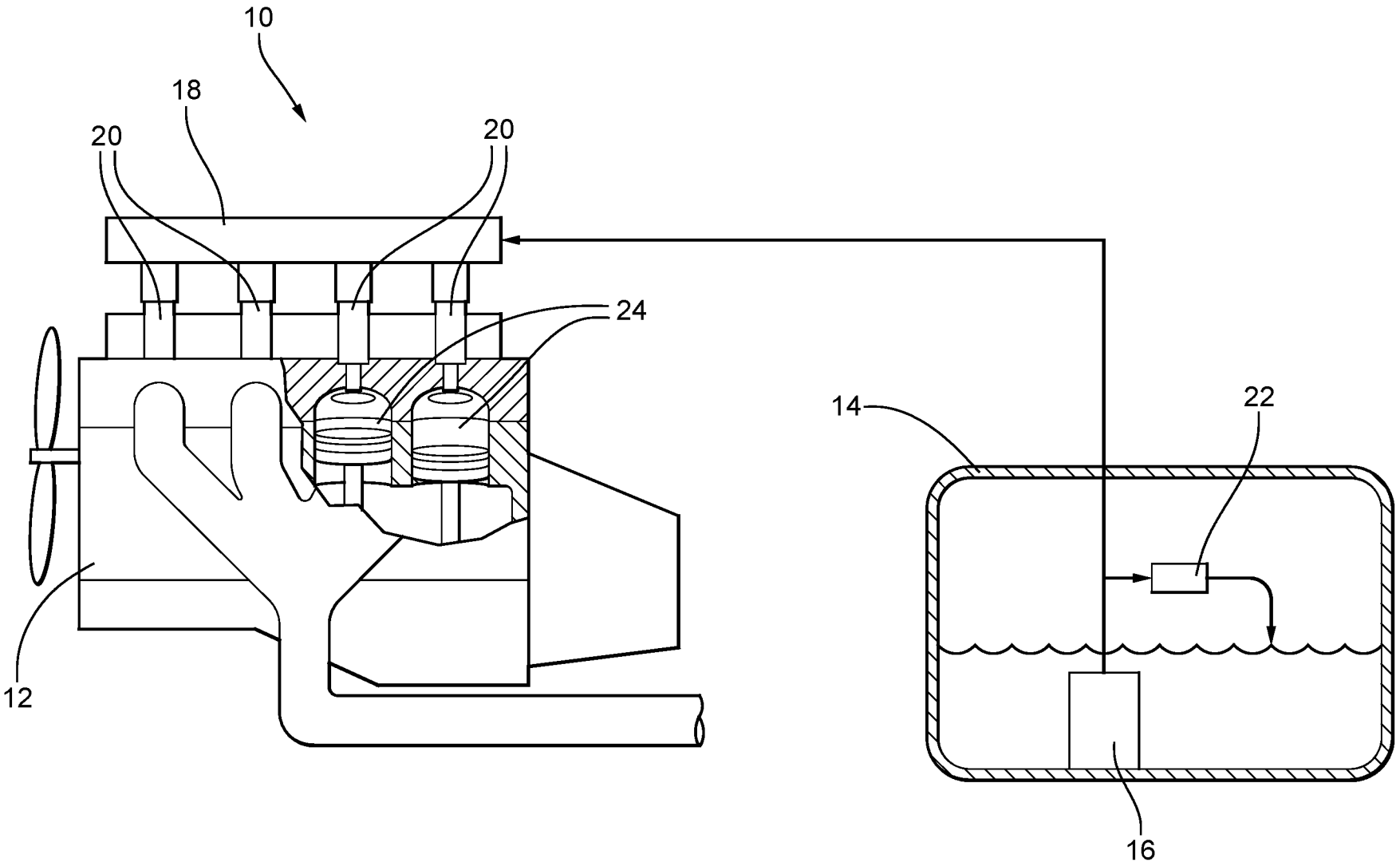
FIG. 1 is a schematic view of a fuel system which includes a fuel pressure regulator in accordance with the present disclosure.
Figure 2A:
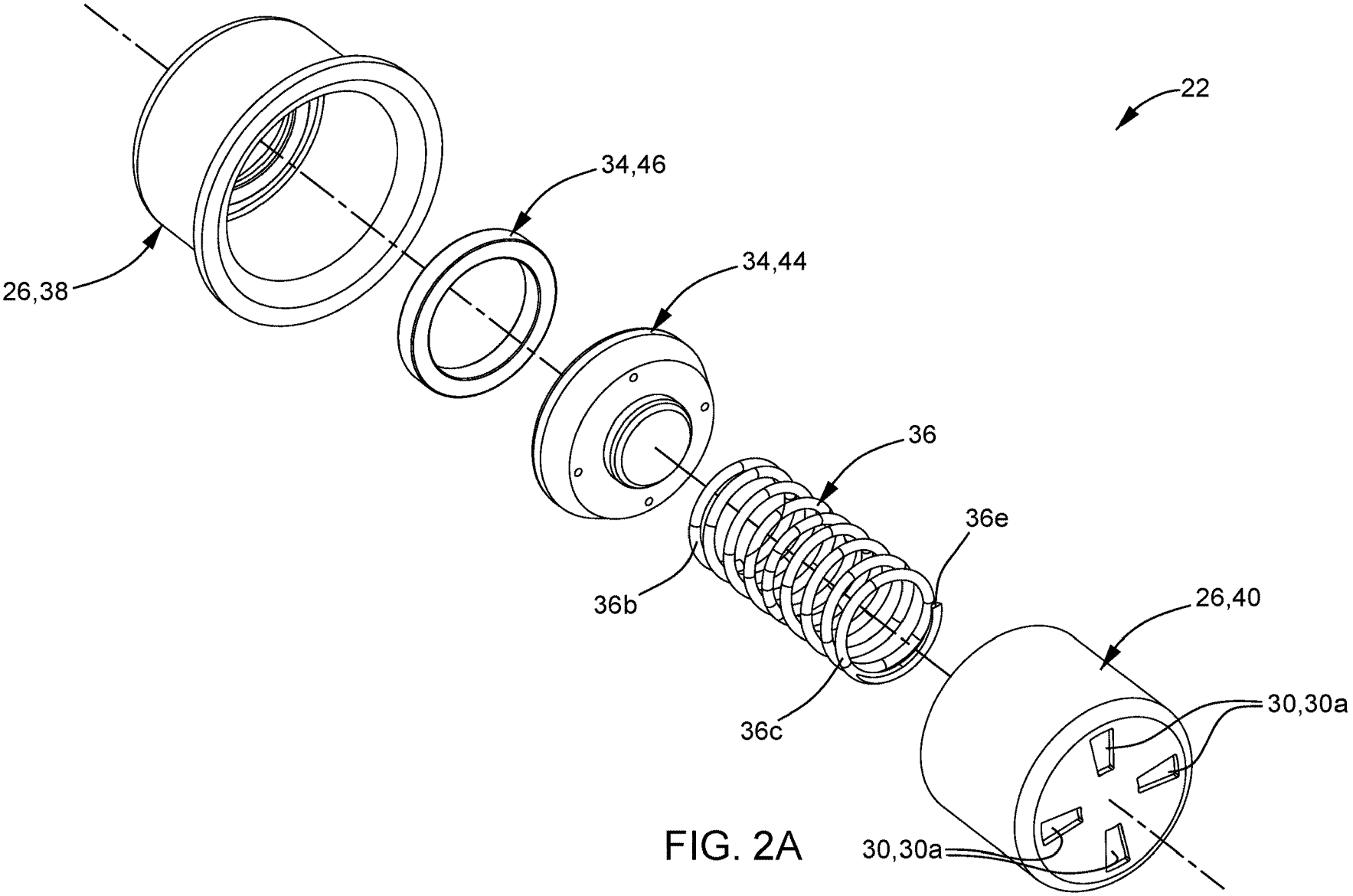
FIGS. 2A and 2B are exploded isometric views of the fuel pressure regulator in accordance with the present disclosure taken from two different perspectives.
Figure 2B:
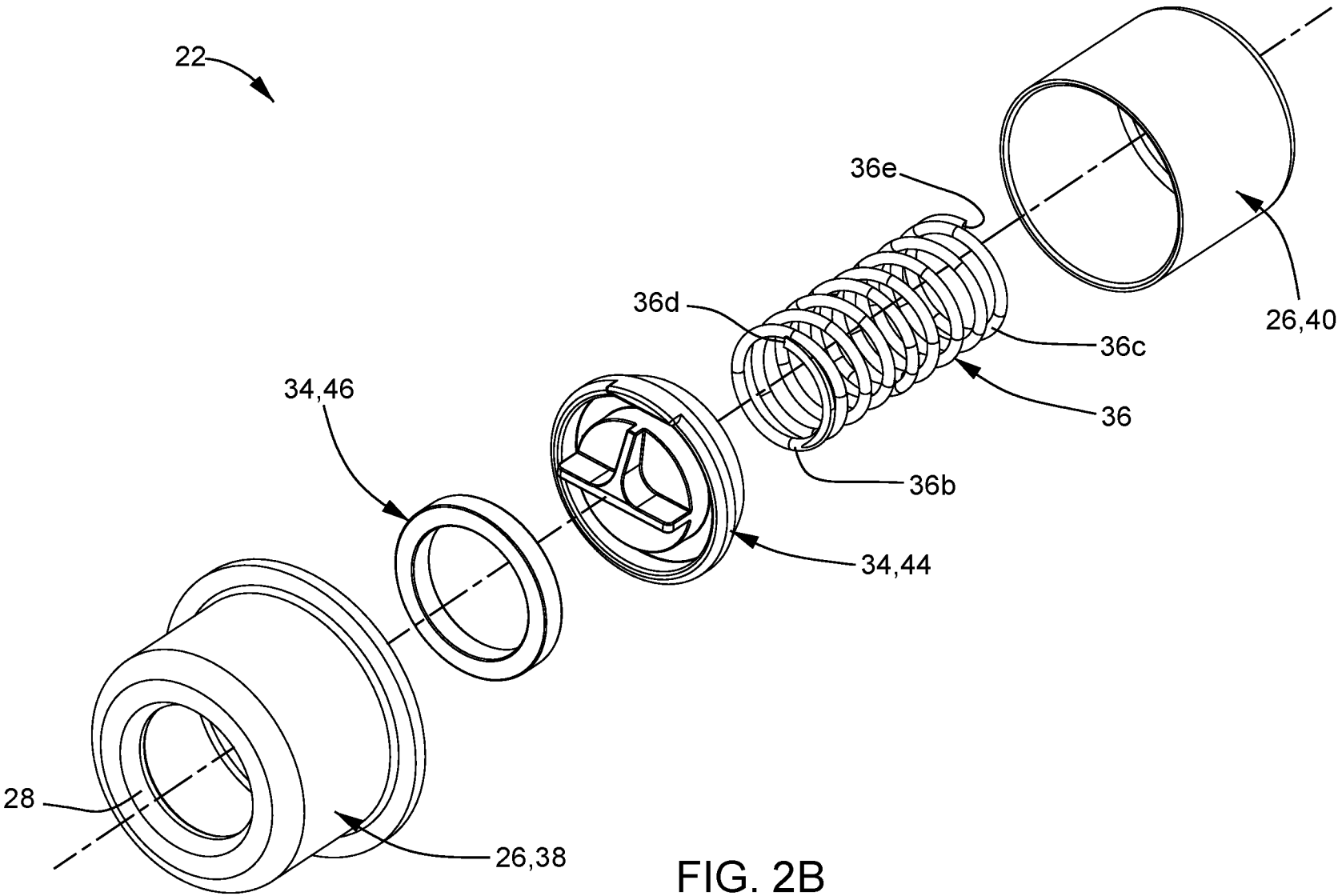

Referring initially to FIG. 1, a fuel system 10 is shown in simplified schematic form for supplying fuel to an internal combustion engine 12, by way of non-limiting example only, for a motor vehicle. Fuel system 10 includes a fuel tank 14 for storing a volume of fuel, a fuel pump 16 which may be located within fuel tank 14 as shown, a fuel rail 18 attached to internal combustion engine 12 and in fluid communication with fuel pump 16, a plurality of fuel injectors 20 in fluid communication with fuel rail 18, and a fuel pressure regulator 22 which regulates the fuel pressure within fuel rail 18. In operation, fuel pump 16 draws fuel from fuel tank 14 and pumps the fuel to fuel rail 18 under pressure. Each fuel injector 20 receives fuel from fuel rail 18 and injects the fuel to a respective combustion chamber 24 of internal combustion engine 12 for combustion of the fuel within combustion chambers 24. Fuel pressure regulator 22 maintains a substantially uniform pressure within fuel rail 18, or to a high-pressure fuel pump in the case of a direct injection system, by recirculating fuel to fuel tank 14 when the pressure within fuel rail 18 is elevated above a predetermined fuel pressure. While fuel pump 16 and fuel pressure regulator 22 have both been illustrated as being located within fuel tank 14, one or both of fuel pump 16 and fuel pressure regulator 22 may alternatively be located outside of fuel tank 14. Furthermore, fuel system 10 may additionally include a high-pressure fuel pump, not illustrated herein, which would be recognized by a practitioner of ordinary skill in the art as being fluidly located between fuel pump 16 and fuel rail 18 in order to further elevate the pressure of the fuel for injection of fuel directly into combustion chambers 24. It should be understood that fuel injectors 20 may inject fuel directly into combustion chambers 24 or may instead inject fuel into the air induction system of internal combustion engine 12 where the fuel is mixed with air before being drawn into combustion chambers 24 through intake combustion valves as in the case of systems commonly referred to as port injection systems.

In accordance with a preferred embodiment of this invention and now referring to FIGS. 2A-5, fuel pressure regulator 22 will be described in greater detail. Fuel pressure regulator 22 generally includes a housing 26 defining a fuel inlet 28 which selectively allows fuel into housing 26 and a fuel outlet 30 which selectively allows fuel out of housing 26; a seating surface 32 located between fuel inlet 28 and fuel outlet 30; a valve member assembly 34 moveable between a closed position (shown in FIG. 3) and an open position (shown in FIG. 4) with seating surface 32; and a spring 36 which biases valve member assembly 34 toward the closed position where spring 36 is a coil compression spring as shown. Fuel inlet 28 is in fluid communication with the outlet of fuel pump 16 while fuel outlet 30 is in fluid communication with the interior of fuel tank 14. The various elements of fuel pressure regulator 22 will be described in the paragraphs that follow.

As illustrated herein, housing 26 comprises a housing first portion 38 and a housing second portion 40. Housing first portion 38 includes a housing first portion circumferential wall 38*a* which is tubular and which extends from a housing first portion first end 38*b* to a housing first portion second end 38*c* along a housing axis 42. Housing first portion circumferential wall 38*a* is preferably cylindrical and centered about housing axis 42. Housing first portion 38 also includes a housing first portion end wall 38*d* which traverses housing first portion first end 38*b* such that fuel inlet 28 extends through housing first portion end wall 38*d*, wherein fuel inlet 28 is centered about housing axis 42. Housing first portion end wall 38*d* includes a bead 38*e* which is annular in shape and which protrudes axially therefrom along housing axis 42 in a direction toward housing first portion second end 38*c*. Bead 38*e* is annular in shape and forms seating surface 32 at the tip thereof which is also annular in shape. As a result of bead 38*e* protruding axially from housing first portion end wall 38*d*, a housing first portion annular recess 38*f* is formed radially between bead 38*e* and housing first portion circumferential wall 38*a*.

Housing second portion 40 includes a housing second portion circumferential wall 40*a* which is tubular and which extends from a housing second portion first end 40*b* to a housing second portion second end 40*c* along housing axis 42. Housing second portion circumferential wall 40*a* is preferably cylindrical and centered about housing axis 42. Housing second portion 40 also includes a housing second portion end wall 40*d* which traverses housing second portion first end 40*b* such that housing second portion end wall 40*d* is planar and perpendicular to housing axis 42. Spring 36 engages housing second portion end wall 40*d* and is grounded thereto such that housing second portion end wall 40*d* does not constrain spring 36 laterally as will be described in greater detail later. Fuel outlet 30, illustrated herein as a plurality of slots 30*a*, extends through housing second portion end wall 40*d*, thereby providing a path for fuel to flow out of housing 26.

As illustrated herein, housing second portion 40 is received within housing first portion 38 such that housing second portion circumferential wall 40*a* is circumferentially surrounded by housing first portion circumferential wall 38*a*, however, this relationship may alternatively be reversed. Housing first portion 38 and housing second portion 40 are fixed together to prevent relative movement therebetween in operation. Fixing together of housing first portion 38 and housing second portion 40 may be accomplished by interference fit between the inner periphery of housing first portion circumferential wall 38*a* and the outer periphery of housing second portion circumferential wall 40*a*, welding, mechanical fasteners, adhesive, combinations of one or more of the foregoing, and the like. By having housing second portion 40 received within housing first portion 38, housing second portion 40 can be inserted within housing first portion 38 sufficiently far during manufacturing to provide a predetermined spring force of spring 36 on valve member assembly 34. Consequently, the extent to which housing second portion 40 is received within housing first portion 38 can be unique to each fuel pressure regulator 22 that is manufactured in order to provide a uniform spring force on spring 36, within an acceptable tolerance range, in order to accommodate manufacturing variations in the various components of fuel pressure regulator 22. In this way, each fuel pressure regular is able to regulate the fuel pressure of fuel system 10 to an acceptable tolerance range.

Housing first portion 38 and housing second portion 40 may each be manufactured from metal, for example stainless steel or may alternatively be manufactured from plastic. When metal is selected, housing first portion 38 and housing second portion 40 may be manufactured from sheet metal which is formed to include the previously described features using punching, stamping, and deep drawing techniques. When plastic is selected, housing first portion 38 and housing second portion 40 may be manufactured using a plastic injection molding process which net-forms the previously described features.

Figure 3:
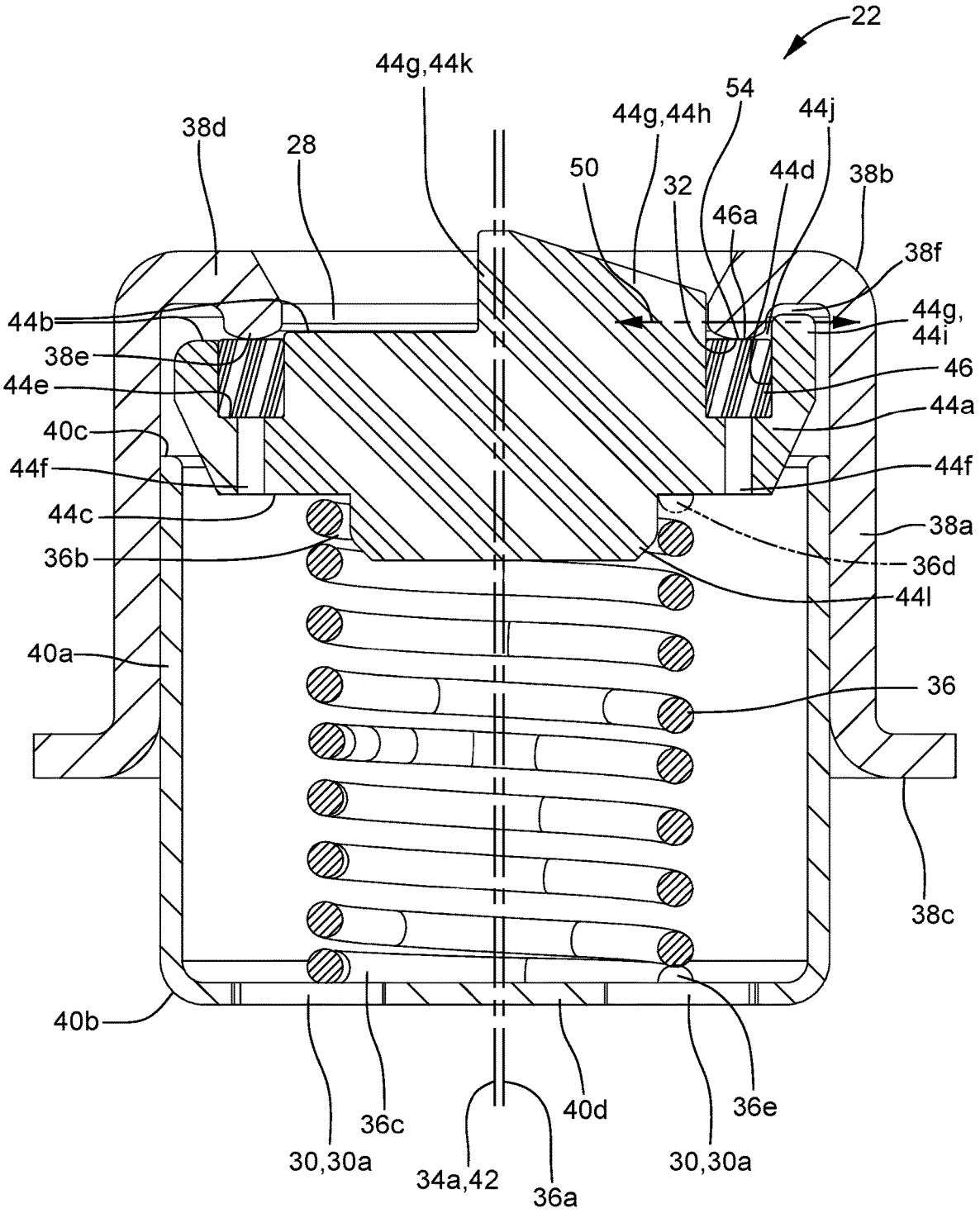
FIG. 3 is a cross-sectional view of the fuel pressure regulator in accordance with the present disclosure and shown in a closed position.
Figure 4:
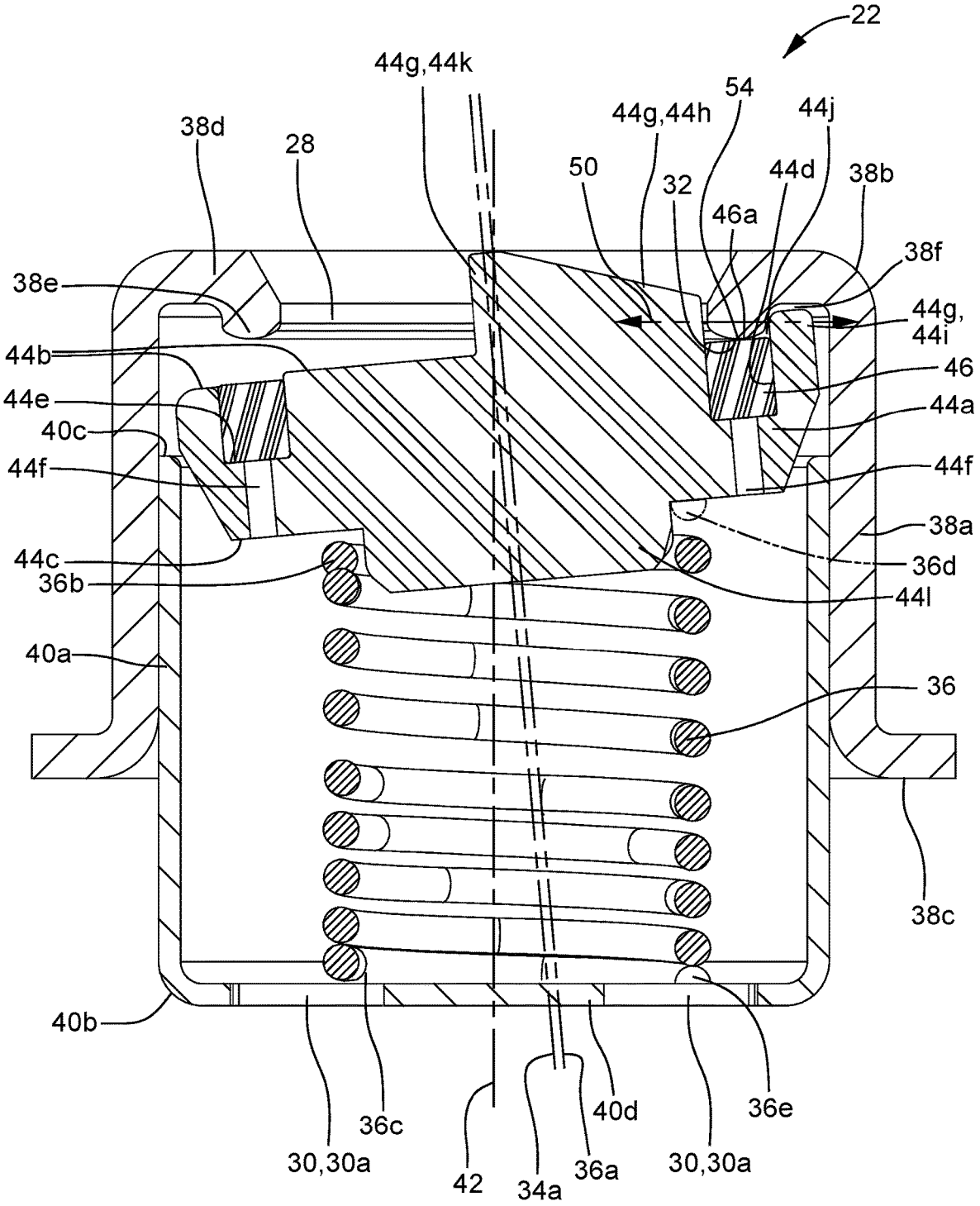
FIG. 4 is the cross-sectional view of FIG. 3, now shown in an open position.
Figure 5:
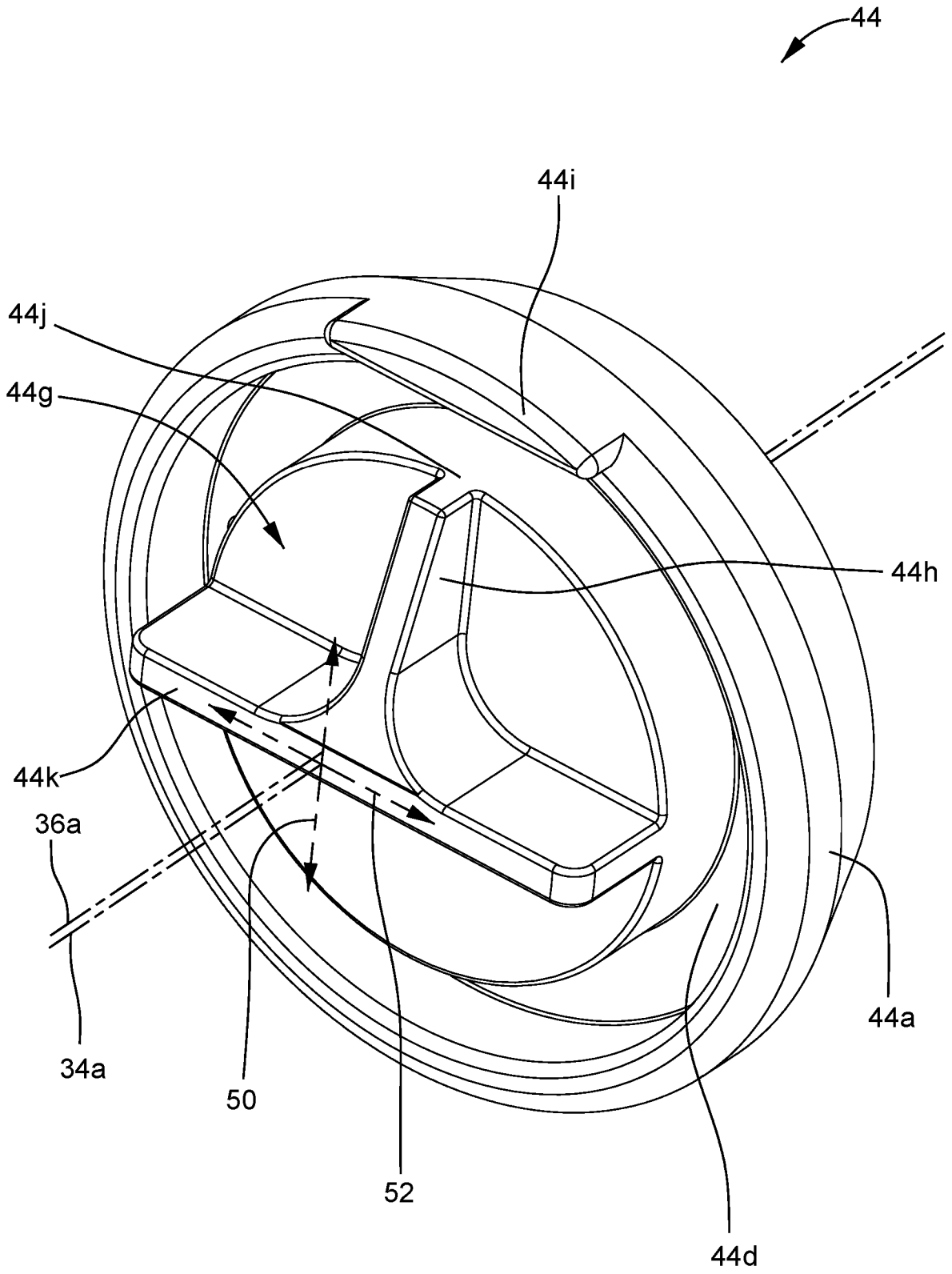
FIG. 5 is an enlarged isometric view of a poppet of FIG. 2B.

Valve member assembly 34 includes a poppet 44 and a sealing member 46 which is supported by poppet 44. Poppet 44 includes a central portion 44*a* which extends along, and is centered about, a valve member assembly axis 34*a* such that central portion 44*a* extends along valve member assembly axis 34*a* from a first surface 44*b* which is traverse to valve member assembly axis 34*a* to a second surface 44*c* which is traverse to valve member assembly axis 34*a*. As can be most easily seen in FIGS. 3 and 4, first surface 44*b* may be stepped, i.e. first surface 44*b* may have a radially inward portion that lies in a different plane than a radially outward portion. It should be noted that when valve member assembly 34 is in a closed position as illustrated in FIG. 3, valve member assembly axis 34*a* is coincident with housing axis 42, however, valve member assembly axis 34*a* is inclined relative to housing axis 42 in an open position as illustrated in FIG. 4. First surface 44*b* faces toward housing first portion end wall 38*d*, and consequently, first surface 44*b* extends radially outward from valve member assembly axis 34*a* to a greater extent than fuel inlet 28. A sealing member groove 44*d* extends into central portion 44*a* from first surface 44*b* such that sealing member groove 44*d* is annular in shape and such that at least a portion of sealing member 46 is received within sealing member groove 44*d*, and consequently, sealing member 46 is centered about valve member assembly axis 34*a*. Sealing member groove 44*d* extends into central portion 44*a* and terminates at a sealing member groove bottom surface 44*e* with which sealing member 46 abuts. In order to prevent a buildup of air between sealing member 46 and sealing member groove bottom surface 44*e* during installation of sealing member 46, which could prevent sealing member 46 from being fully inserted into sealing member groove 44*d*, central portion 44*a* includes one or more vent passages 44*f* which extend from sealing member groove 44*d* to an exterior surface of poppet 44. As illustrated herein, vent passages 44*f* may preferably extend in a direction parallel to housing axis 42 which may allow for simple formation thereof in a plastic injection molding operation which net-forms poppet 44.

Poppet 44 also includes a guiding portion 44*g* which extends away from first surface 44*b* and into fuel inlet 28 and housing first portion annular recess 38*f*. Guiding portion 44*g* includes a first retention rib 44*h* which extends away from first surface 44*b* at a location radially inward from sealing member groove 44*d* such that first retention rib 44*h* extends into fuel inlet 28. Guiding portion 44*g* also includes a second retention rib 44*i* which extends away from first surface 44*b* at a location radially outward from sealing member groove 44*d* such that first retention rib 44*h* and second retention rib 44*i* are radially aligned with each other and such that first retention rib 44*h* and second retention rib 44*i* are spaced apart by a gap 44*j*. Bead 38*e* is located within gap 44*j* when valve member assembly 34 is in the closed position and in the open position, and consequently, first retention rib 44*h* and second retention rib 44*i* constrain valve member assembly 34 in a direction perpendicular to housing axis 42 in a first direction 50 shown in FIGS. 4 and 5. Guiding portion 44*g* also includes a guiding rib 44*k* which extends away from first surface 44*b* at a location radially inward from sealing member groove 44*d*. Guiding rib 44*k* is traverse to first retention rib 44*h*, preferably perpendicular, such that first retention rib 44*h* intersects with guiding rib 44*k*. Guiding rib 44*k* extends to diametrically opposing locations of sealing member groove 44*d* and extends into fuel inlet 28 such that guiding rib 44*k* provides guidance against the inner periphery of fuel inlet 28 when valve member assembly 34 opens and closes. In this way, guiding rib 44*k* constrains valve member assembly 34 in a second direction 52 which is perpendicular to housing axis 42 and which is perpendicular to first direction 50. It should be noted that the tips of first retention rib 44*h* and guiding rib 44*k*, i.e. the surfaces at the radial extent thereof that extend to the axial end faces of first retention rib 44*h* and guiding rib 44*k* respectively, may be angled or radiused to minimize contact with the inner periphery of fuel inlet 28 and to minimize hysteresis during operation.

Poppet 44 also includes a spring guide portion 441 which extends away from second surface 44*c* and which is centered about a spring axis 36*a* which is laterally relative to, i.e. eccentric to, valve member assembly axis 34*a* such that spring axis 36*a* is parallel to valve member assembly axis 34*a*. One end of spring 36 abuts second surface 44*c* such that spring guide portion 441 laterally, i.e. perpendicular to housing axis 42, positions one end of spring 36 in order to maintain the position of spring 36 on poppet 44 in a position which is not centered about valve member assembly axis 34*a*.

Sealing member 46 is annular in shape and is made of an elastomer material which is resilient and compliant, and may be, by way of non-limiting example only, FKM or nitrile. Sealing member 46 may be a standard O-ring which has a circular cross-sectional shape, i.e. when sectioned parallel to housing axis 42, prior to being installed within sealing member groove 44*d*, or may be square or rectangular in cross-sectional shape as illustrated in the figures. Sealing member 46 includes a sealing member surface 46*a* which faces toward, and which is axially aligned with, seating surface 32. When valve member assembly 34 is in the closed position, sealing member surface 46*a* annularly engages seating surface 32, thereby preventing fuel flow from fuel inlet 28 to fuel outlet 30. Conversely, when valve member assembly 34 is in the open position as a result of fuel pressure upstream of fuel inlet 28 being sufficiently high to overcome the force of spring 36, sealing member surface 46*a* is spaced apart from seating surface 32, thereby allowing fuel flow from fuel inlet 28 to fuel outlet 30. The resilient and compliant nature of sealing member 46 ensures a positive seal when valve member assembly 34 is in the closed position and minimizes or eliminates the need for post-processing of seating surface 32.

Spring 36, as embodied herein, is a coil compression spring which is centered about spring axis 36*a* in the closed position and which includes a plurality of coils such that an initial coil 36*b* engages poppet 44 and such that a final coil 36*c* engages housing second portion end wall 40*d*. As used herein, initial coil 36*b* is the coil which makes up the first 360° of spring 36 and final coil 36*c* is the coil which makes up the last 360° of spring 36. Final coil 36*c* is unconstrained laterally relative to spring axis 36*a* which allows final coil 36*c* to self-center relative to initial coil 36*b*, i.e. final coil 36*c* is able to be passively centered with initial coil 36*b*. It should also be noted that final coil 36*c* overlays slots 30*a* which make up fuel outlet 30 such that slots 30*a* extend radially inward beyond the inner periphery of final coil 36*c* and radially outward beyond the outer periphery of final coil 36*c*, thereby preventing final coil 36*a* from getting caught at the ends of slots 30*a* which could prevent final coil 36*c* from self-centering relative to initial coil 36*b*. Spring 36 is terminated at initial coil 36*b* by a first termination 36*d* and is terminated at final coil 36*c* by a second termination 36*e*. Furthermore, first termination 36*d* and second termination 36*e* can either be ground or unground and their angular position relative to teach other and to a pivot interface 54 created by seating surface 32 contacting sealing member surface 46*a* can be used to control pivoting movement of valve member assembly 34 when valve member assembly 34 opens.

In operation, when the fuel pressure at fuel inlet 28 is elevated to a predetermined pressure, the fuel pressure acting on poppet 44 causes valve member assembly 34 to move from the closed position, which is shown in FIG. 3 and in which sealing member surface 46*a* annularly engages seating surface 32 to prevent fuel from flowing from fuel inlet 28 to fuel outlet 30, to an open position, which is shown in FIG. 4 and in which at least a portion of sealing member surface 46*a* is spaced apart from seating surface 32 to allow fuel to flow from fuel inlet 28 to fuel outlet 30. Since spring axis 36*a* is laterally offset relative to valve member assembly axis 34*a*, movement of valve member assembly 34 between the open position and the closed position is a pivoting movement of valve member assembly 34 about pivot interface 54 created by seating surface 32 contacting sealing member surface 46*a*. As can be seen best in FIGS. 3 and 4, pivot interface 54 is located within gap 44*j* between first retention rib 44*h* and second retention rib 44*i*. In addition to spring axis 36*a* being laterally offset relative to valve member assembly axis 34*a*, pivoting of valve member assembly 34 about pivot interface 54 is also promoted by the location of first termination 36*d* and second termination 36*e*. More specifically, first termination 36*d* and second termination 36*e* are each preferably located at a radial location around spring axis 36*a* which is aligned with pivot interface 54 within a range of −45° to 45°. Furthermore, first termination 36*d* and second termination 36*e* are preferably located within 60° of each other around spring axis 36*a* in order to promote desired pivoting of valve member assembly 34.

Fuel pressure regulator 22 as described herein allows for a positive seal in the closed position, is compact, and is simple and inexpensive to manufacture. Furthermore, the pivoting nature of valve member assembly 34 minimizes hysteresis and noise.

While this invention has been described in terms of preferred embodiments thereof, it is not intended to be so limited, but rather only to the extent set forth in the claims that follow.

We claim:

1. A fuel pressure regulator comprising:

a fuel inlet;

a fuel outlet;

a seating surface between said fuel inlet and said fuel outlet which is annular in shape;

a valve member assembly comprising a poppet and also comprising a sealing member which is made of an elastomer material and which is annular in shape and includes a sealing member surface such that said sealing member is centered about a valve member assembly axis, said sealing member being supported by said poppet, and said valve member assembly being moveable between 1) a closed position in which said sealing member surface annularly engages said seating surface, thereby preventing fuel flow from said fuel inlet to said fuel outlet and 2) an open position in which at least a portion of said sealing member surface is spaced apart from said seating surface, thereby allowing fuel flow from said fuel inlet to said fuel outlet; and a spring which biases said valve member assembly toward said closed position, wherein said spring is centered about a spring axis which is laterally offset relative to said valve member assembly axis, thereby causing said valve member assembly to pivot, when moving between said closed position and said open position, about a pivot interface created by said seating surface contacting said sealing member surface.

2. A fuel pressure regulator as in claim 1, wherein said seating surface contacts said sealing member surface at said pivot interface in said open position.

3. A fuel pressure regulator as in claim 1, wherein said said fuel pressure regulator comprises a housing;

said fuel inlet selectively allows fuel into said housing; and said fuel outlet selectively allows fuel out of said housing.

4. A fuel pressure regulator as in claim 3, wherein:

said housing includes a housing first portion having a housing first portion circumferential wall which is tubular and which extends from a housing first portion first end to a housing first portion second end and also having a housing first portion end wall which traverses said housing first portion first end;

said fuel inlet extends through said housing first portion end wall and is centered about a housing axis which is coincident with said valve member assembly axis in said closed position;

said seating surface circumferentially surrounds said fuel inlet; and an annular recess circumferentially surrounds said seating surface and extends from said seating surface in a direction toward said housing first portion first end.

5. A fuel pressure regulator as in claim 4, wherein:

said seating surface is formed by a bead which is annular in shape and which protrudes from said housing first portion end wall; and said poppet includes a first retention rib and a second retention rib such that said first retention rib and said second retention rib are spaced apart by a gap such that said bead is located within said gap when said valve member assembly is in said closed position and when said valve member assembly is in said open position.

6. A fuel pressure regulator as in claim 5, wherein:

said poppet also includes a central portion which extends along, and is centered about said valve member assembly axis from a first surface which is traverse to said valve member assembly axis to a second surface which is traverse to said valve member assembly axis;

said poppet also includes a sealing member groove which extends into said first surface such that said sealing member groove is annular in shape and centered about said valve member assembly axis, wherein said sealing member is received within said sealing member groove; and said first retention rib extends from said first surface in a direction parallel to said valve member assembly axis such that said first retention rib extends from said first surface at a location that is radially inward from said sealing member groove.

7. A fuel pressure regulator as in claim 6, wherein said second retention rib extends away from said first surface in the direction parallel to said valve member assembly axis such that said second retention rib extends from said first surface at a location that is radially outward from said sealing member groove.

8. A fuel pressure regulator as in claim 6, wherein said poppet also includes a guiding rib which is traverse to said first retention rib, said guiding rib providing guidance against an inner periphery of said fuel inlet when said valve member assembly moves between said open position and said closed position.

9. A fuel pressure regulator as in claim 8, wherein said guiding rib extends to diametrically opposing locations of said sealing member groove.

10. A fuel pressure regulator as in claim 8, wherein:

said housing includes a housing second portion having a housing second portion circumferential wall which is tubular and extends from a housing second portion first end to a housing second portion second end and also having a housing second portion end wall which traverses said housing second portion first end; and said spring is grounded to said housing second portion end wall.

11. A fuel pressure regulator as in claim 5, wherein said pivot interface is located within said gap.

12. A fuel pressure regulator as in claim 4, wherein:

said housing includes a housing second portion having a housing second portion circumferential wall which is tubular and extends from a housing second portion first end to a housing second portion second end and also having a housing second portion end wall which traverses said housing second portion first end;

said spring is grounded to said housing second portion end wall; and said fuel outlet extends through said housing second portion end wall.

13. A fuel pressure regulator as in claim 12, wherein:

said spring is a coil spring having a plurality of coils such that an initial coil thereof engages said poppet and a final coil thereof engages said housing second portion end wall; and said final coil in unconstrained in a direction laterally relative to said spring axis, thereby allowing said final coil to self-center relative to said initial coil.

14. A fuel pressure regulator as in claim 13, wherein said final coil overlays said fuel outlet.

15. A fuel pressure regulator as in claim 14, wherein said fuel outlet comprises a plurality of slots such that said final coil overlays each of said plurality of slots.

16. A fuel pressure regulator as in claim 15, wherein each of said plurality of slots extend beyond an inner periphery of said final coil and extend beyond an outer periphery of said final coil.

17. A fuel pressure regulator as in claim 13, wherein:

said initial coil includes a first termination located at a radial location around said spring axis which is aligned with said pivot interface within a range of −45° to 45°; and said final coil includes a second termination located a radial location around said spring axis which is aligned with said pivot interface within a range of −45° to 45°.

18. A fuel pressure regulator as in claim 17, wherein said first termination and said second termination are located within 60° of each other around said spring axis.

19. A fuel pressure regulator as in claim 1, wherein:

said spring is a coil spring having a first termination proximal to said valve member assembly and a second termination distal from said valve member assembly; and said first termination is located at a radial location around said spring axis which is aligned with said pivot interface within a range of −45° to 45°;

said second termination is located a radial location around said spring axis which is aligned with said pivot interface within a range of −45° to 45°.

20. A fuel pressure regulator as in claim 19 wherein said first termination and said second termination are located within 60° of each other around said spring axis.

* * * * *